US006266865B1

(12) United States Patent
Ehrlich

(10) Patent No.: US 6,266,865 B1
(45) Date of Patent: Jul. 31, 2001

(54) METHOD OF PUNCHING A COMPOSITE PLATE

(75) Inventor: Rodney P. Ehrlich, Monticello, IN (US)

(73) Assignee: Wabash Technology Corporation, Arlington Heights, IL (US)

( * ) Notice: Subject to any disclaimer, the term of this patent is extended or adjusted under 35 U.S.C. 154(b) by 0 days.

(21) Appl. No.: 09/398,384

(22) Filed: Sep. 17, 1999

(51) Int. Cl.[7] ..... B21J 15/02

(52) U.S. Cl. ..... 29/525.06; 29/525.05; 29/525.01; 83/327; 83/328; 72/36; 72/51

(58) Field of Search ..... 29/525.01, 525.06, 29/525.05; 83/51, 36; 72/327, 328

(56) References Cited

U.S. PATENT DOCUMENTS

| | | | | |
|---|---|---|---|---|
| 2,185,885 | | 1/1940 | Bruker et al. . | |
| 2,371,734 | | 3/1945 | Buttress . | |
| 2,419,862 | | 4/1947 | Wales . | |
| 3,878,746 | * | 4/1975 | Carmeli | 83/126 |
| 4,477,537 | * | 10/1984 | Blase et al. | 428/577 |
| 4,940,279 | | 7/1990 | Abott et al. . | |
| 4,958,472 | | 9/1990 | Ehrlich . | |
| 5,040,442 | | 8/1991 | Nasu . | |
| 5,774,972 | * | 7/1998 | Ehrlich | 29/525.06 |

FOREIGN PATENT DOCUMENTS

| | | | |
|---|---|---|---|
| 619168 | * | 3/1983 | (CH) . |
| 1435301 | | 11/1968 | (DE) . |
| 723340 | | 4/1932 | (FR) . |
| 2111896 | | 7/1983 | (GB) . |
| 56-165531 | | 12/1981 | (JP) . |
| 358044934 | * | 3/1983 | (JP) . |
| 280134 | | 3/1990 | (JP) . |
| 404247927 | * | 9/1992 | (JP) . |

* cited by examiner

*Primary Examiner*—S. Thomas Hughes
*Assistant Examiner*—John C. Hong
(74) *Attorney, Agent, or Firm*—Trexler, Bushnell, Giangiorgi, Blackstone & Marr, Ltd.

(57) ABSTRACT

A novel method is provided for forming a clear hole through a composite plate. At least two plates can be joined together to form a wall of a trailer. The following steps are taken to perform the method: A punching apparatus is advanced through an extension skin of a first composite plate and a first skin of a second composite plate, thereby compressing the core material of the second composite plate and forming a first slug. The apparatus is withdrawn therefrom. The composite plates are flipped over. The apparatus is advanced through a second skin of the second composite plate, forming a second slug. The apparatus is further advanced through the core material of the second composite plate, thereby ejecting the first slug, a portion of the core material of the second composite plate and the second slug to form a hole through the extension skin and the second composite plate. The apparatus is then withdrawn from the second composite plate. The hole is then re-punched and re-withdrawn in order to remove any excess core material which may have expanded into the hole. A rivet can be easily placed through the hole to join the plates together. The re-punching and re-withdrawing step can be eliminated from the method by providing a shoulder on the apparatus. The shoulder will remove any excess core material which may expand into the hole prior to the apparatus being withdrawn from the second composite plate.

42 Claims, 11 Drawing Sheets

METHOD OF PUNCHING A COMPOSITE PLATE

BACKGROUND OF THE INVENTION

This invention is generally directed to a novel method of punching a composite plate.

One prior art method of punching a hole in a composite plate, which is formed of first and second skins with a core sandwiched therebetween, was performed by punching a hole through the plate with a single punch by using a punching apparatus. Due to the spring back qualities of the core material, the core material entered into the hole formed by the punch after the punch was removed from its engagement with the plate. Therefore, the hole created by the punch was not clear and a rivet could not be placed therethrough without first completely clearing the hole by using separate, special tools.

The special tools are used to drill out or remove the excess core material within the hole. These tools are expensive and the process of removing the excess core material is labor intensive.

Another prior art method which is disclosed in this inventor's U.S. Pat. No. 5,774,972, and which is commonly owned by the Assignee herein, uses a novel double punching method to punch the composite plate. This method eliminates the need for special tools to drill out or remove the excess core material within the hole. A problem has been found with this method in that, at times, when the punch is driven completely through the first overlaying skins, the core and the second skin, after breaking the first skins and driving them through the core, the first skins sometimes slipped to the side of the punch, causing the resulting hole to be improperly aligned.

The present invention resolves the problems found in the prior art. The present invention provides a novel method for punching a composite plate which eliminates the step of drilling out or removing excess core material within the hole by using a separate tool and eliminates improper alignment of the resulting hole. In addition, the method of the present invention presents several other advantages and features including the provision of a novel joint structure which will become apparent upon a reading of the attached specification.

OBJECTS AND SUMMARY OF THE INVENTION

A general object of the present invention is to provide a novel method of punching a composite plate to provide a hole through the composite plate which is free of interfering material.

An object of the present invention is to provide a novel method of providing a clear hole through a composite plate without using a separate tool to remove excess material from the hole.

Briefly, and in accordance with the foregoing, the present invention discloses a novel method for forming a clear hole through a composite plate. The composite panel is twice punched by a punching apparatus to form the clear hole. At least two composite plates can be joined together through the clear hole to form a wall panel, such as may be used in a trailer.

Each composite plate is formed from first and second metal skins having a resilient plastic core sandwiched therebetween. The second skin of one plate and the first skin of the adjacent plate each include an integrally formed skin extension which extends past the end of the respective cores and overlaps the respective first or second skin on the adjacent plate.

To perform the method, the following steps are performed: The composite plates are placed adjacent to each other such that the ends of the cores abut against each other and the skin extensions overlap the respective first or second skin of the adjacent composite plate. Thereafter, the punching apparatus is engaged with the plate to be punched to compress the plate core material.

The punching apparatus punches through the extension skin of one plate and the first skin of the adjacent plate, forming a first slug which is slightly pushed into the core material of the adjacent plate. The punching apparatus is then withdrawn from its engagement. The composite plates are flipped over so that the area of the broken extension and first skins are in the direct path of the punching apparatus. Next, the punching apparatus is engaged with the plate to compress the core material. The punching apparatus then punches through the second skin of the plate, forming a second slug which is pushed into the core material of the adjacent plate. The punching motion is continued to punch entirely through the adjacent plate and the extension skin, thereby ejecting the first slug, a portion of the core material and the second slug of the plate, completing the formation of a hole through the plate and the extension skin. The punching apparatus is then withdrawn from its engagement and the core is allowed to expand, due to the spring back qualities of the resilient core material, into the hole. Next, the punching apparatus is re-engaged with the second skin of the plate and compresses the core. The punching apparatus re-punches through the plate and the extension skin in the same location as the punched hole to shear any excess material from within the hole. The punching apparatus is then re-withdrawn from its engagement with the composite plate. After re-punching through the same hole area, the hole is clear and free of any interfering material. A rivet can be easily placed through the hole to join the plates together.

An enlarged shoulder can also be added to the punching apparatus to eliminate the re-punching and re-withdrawing steps from the method. During the withdrawing of the punching apparatus after creating the hole, the shoulder on the punching apparatus will shear any excess core material that has expanded in the hole behind the shoulder from within the hole.

Of course, a composite plate can be punched by using the novel method described herein to form a hole clear of any interfering material by first punching the second skin, then flipping the plate over, and then punching the extension and first skins. Also, a composite plate having only first and second skins and a core can be punched by using the novel method described herein to form a hole clear of any interfering material. That is, a composite plate, without the provision of an overlapping skin can be punched by using this method.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
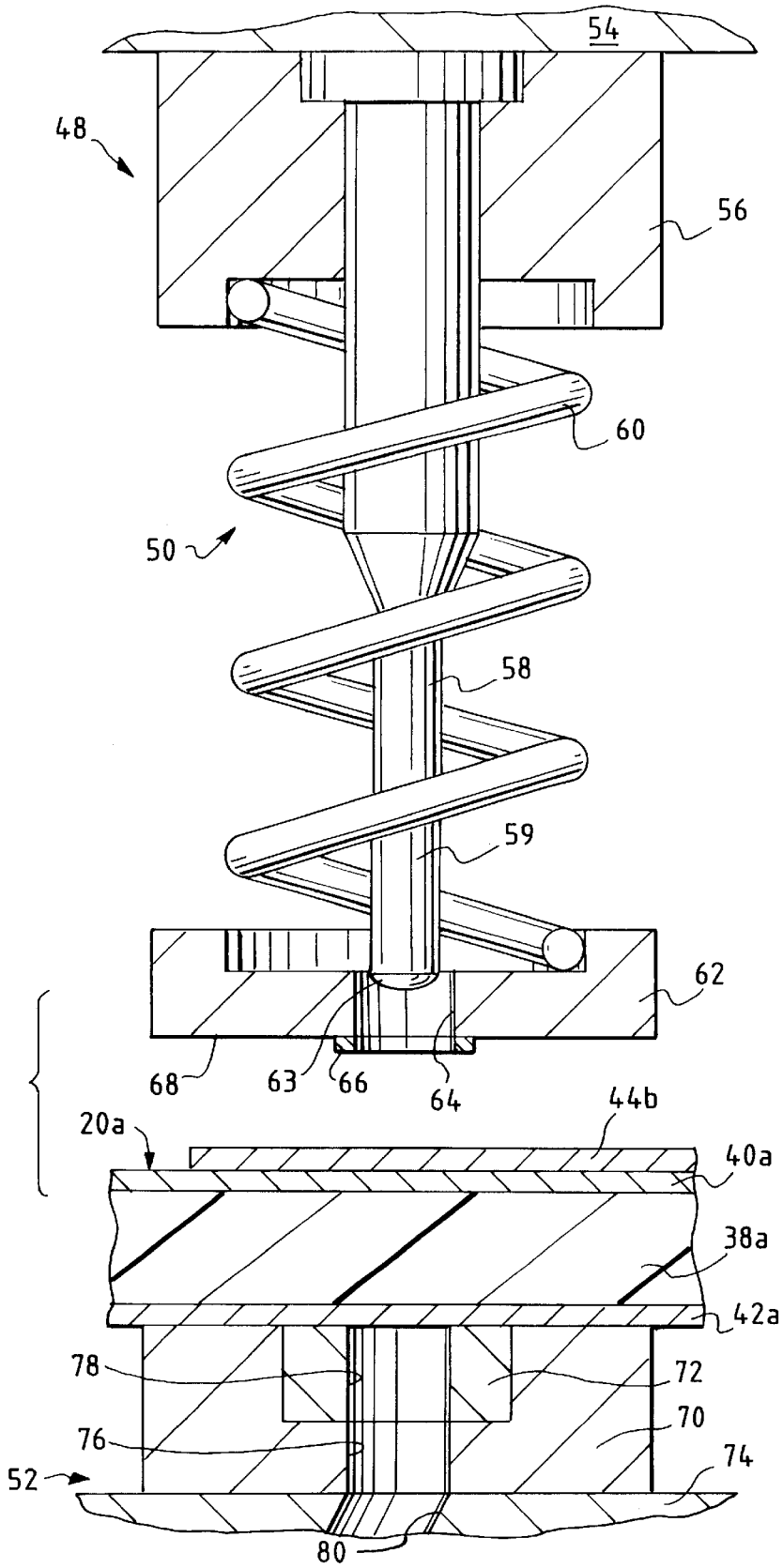
FIGS. 1–11 are cross-sectional views that display the method of punching a clear hole through a composite plate as described in the first embodiment.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The present invention presents a novel method of punching a composite plate 20 to form a hole 22 through the plate 20 which is clear and free of interfering materials in the hole 22. No separate tools, as are necessary in prior art methods of forming a hole through a composite plate, are required to clear out the hole 22 after the composite plate 20 is punched by the methods described herein.

Figure 23:
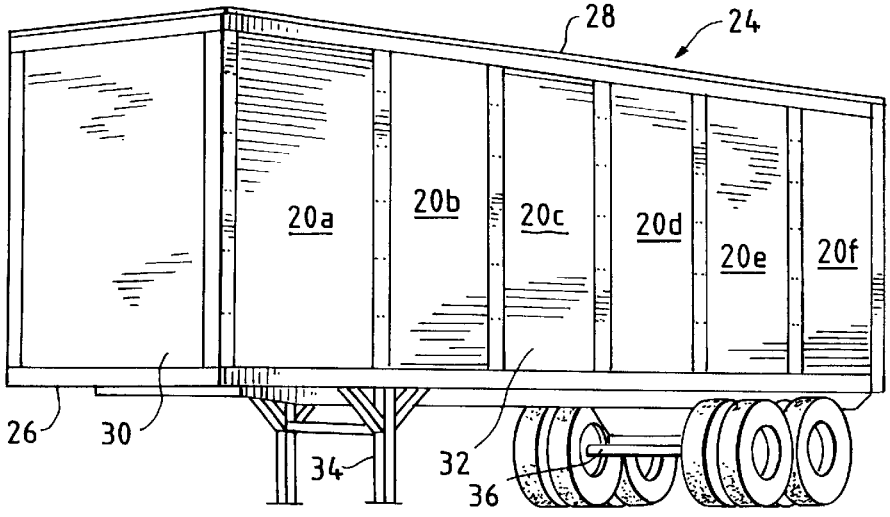
FIG. 23 is a perspective view of a trailer in which the punched composite plate is used to form a side wall of the trailer.

The composite plate 20 formed in accordance with the present invention can be used to form a wall panel in a trailer 24, shown in FIG. 23. The trailer 24 is generally comprised of a floor 26, a roof 28, a front wall 30, a pair of opposite side walls 32 (only one of which is shown), rear cargo doors (not shown), a landing gear 34, and an undercarriage assembly 36.

Each side wall 32 of the trailer 24 is formed from a plurality of composite plates shown in the drawings as 20*a*–20*f*.

The structure of each composite plate 20*a*–20*f* is described with respect to composite plate 20*a* with the understanding that the other composite plates are identically formed. Composite plate 20*a* is formed from a core 38*a* sandwiched between a first skin 40*a* and a second skin 42*a*. The skins 40*a*, 42*a*, are preferably formed of full hard, high strength, high tension, galvanized steel. Preferably, the first skin 40*a* is formed from G60 (60 grams/meter) galvanized steel and the second skin 42*a* is formed from G90 (90 grams/meter) galvanized steel. The core 38*a* is preferably made of a light-weight, resilient plastic material, such as high density polyethylene (HDPE) or polypropylene. The skins 40*a*, 42*a* may be adhesively bonded or otherwise affixed to the core 38*a*. A skin extension 44*a* is integrally formed with the respective first skin 40*a* or second skin 42*a* of the composite plate 20*a* which extends beyond the end of the core 38*a*. The skin extension 44*a* is used to overlap the respective skin of the adjacent composite plate.

Figure 22:
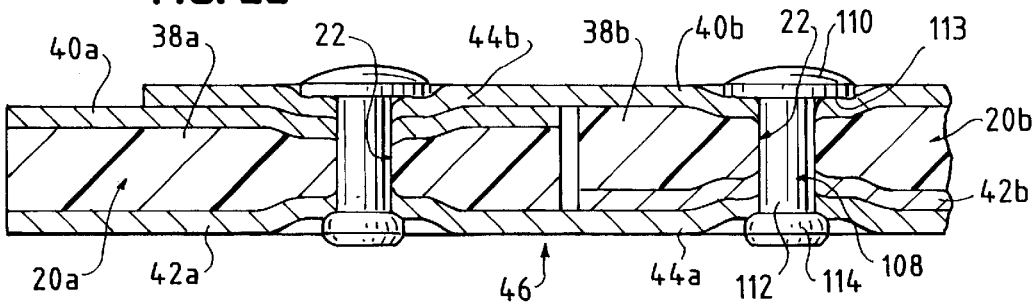
FIG. 22 is a cross-sectional view of adjacent composite plates attached together by rivets to form a joint.

FIG. 22 shows the preferred construction of joined or spliced adjacent composite plates 20*a*, 20*b* in the final form which are used to form the side walls 32 of the trailer 24. Such a construction of joined or spliced adjacent composite plates 20 is disclosed in U.S. Pat. No. 4,940,279, which disclosure is herein incorporated by reference. The ends of the plates 20*a*, 20*b* abut directly against one another. The skin extensions 44*a*, 44*b* form an overlap joint 46 for joining the adjacent plates 20*a*, 20*b* together. As shown, the skin extension 44*a* which is integral with the second skin 42*a* of composite plate 20*a* overlaps the second skin 42*b* of composite plate 20*b*, and the skin extension 44*b*, which is integral with the first skin 40*b* of composite plate 20*b*, overlaps the first skin 40*a* of composite plate 20*a*. The skin extensions 44*a*, 44*b* seat tightly against the respective first and second skins 42*b*, 40*a*.

Preferably, each composite plate 20*a*–20*f* is rectangular having a height greater than its width. Each composite plate 20*a*–20*f* (without the respective skin extension, for example 44*a*, 44*b*) is approximately forty nine inches in length. Each skin 40*a*, 42*a*; 40*b*, 42*b* and thus each skin extension 44*a*, 44*b* is preferably nineteen thousandths of an inch in thickness. The overall thickness of each composite plate 20*a*–20*f* is approximately two hundred and thirty thousands of an inch.

To join or splice adjacent composite plates 20*a*–20*f* together to form the side wall 32 of the trailer 24, the novel method of the present invention described herein is used. For ease and clarity in describing the present invention, the punching method is described with respect to the composite plate 20*a* and the skin extension 44*b* which overlaps the first skin 40*a* of the composite plate 20*a*, except where the composite plate 20*b* and second skin extension 44*a* are specifically described. The composite plates 20*a*, 20*b* are punched in the area of the overlap joint 46, that is, through the composite plate 20*a* or 20*b* and the respective skin extension 44*b*, 44*a* to form a hole 22. Preferably, in the particular embodiment disclosed, the holes 22 formed through the composite plates 20*a*, 20*b* are one and a quarter inches apart from each other along a four foot plate. A first embodiment of the method is shown in FIGS. 1–11 and a second embodiment of the method is shown in FIGS. 12–19. For ease and clarity in describing the present invention, the punching method is described with respect to the composite plate 20*a* and the skin extension 44*b* which overlaps the first skin 40*a* of the composite plate 20*a*, except where the composite plate 20*b* and second skin extension 44*a* are specifically described. It is to be understood that the method of the present invention can be used to punch a composite plate that does not include a skin extension to provide a clear hole through the composite plate. In addition, the method of the present invention can be used to punch other forms of joints between composite plates.

Attention is now drawn to the method of punching the plates in FIGS. 1–11.

The punching apparatus 48 includes a top structure 50 and a bottom structure 52. The composite plate 20*a* is placed between the structures 50, 52 during the novel punching process described herein.

The top structure 50 generally includes a press ram 54, a punch holder 56, a punch 58 having a shaft 59, a spring 60 having a predetermined spring constant and a stripper plate 62. The top structure 50 can be moved upwardly and downwardly relative to the bottom structure 52.

The punch holder 56 and punch 58 are fixedly attached to the press ram 54 and extend downwardly therefrom toward the bottom structure 52. The punch 58 shaft 59 of the may have any desired diameter, but in the embodiment disclosed, the shaft 59 preferably has a diameter of approximately two hundred and sixty-five thousands of an inch. The punch 58 also has a tip 63, which in the preferred embodiment, is curved. However, it would be apparent to those of ordinary skill in the art to shape the tip in other forms in order to serve the same purpose that the curved tip of the preferred embodiment serves as described herein.

One end of the spring 60 is connected to the punch holder 56 and the other end is connected to an upper surface of the stripper plate 62. The punch 58 is positioned through the middle of the spring 60 and is aligned with a bore 64 through the stripper plate 62. The stripper plate 62 includes an embossment 66 thereon which extends downwardly from a plate engaging surface 68 and encircles the bore 64 in the stripper plate 62. The embossment 66 is approximately twenty thousands of an inch (slightly less than the thickness of one skin of the composite plate). Other dimensions for the embossment 66 and skins of the composite plate may be used depending on the application.

The bottom structure 52 generally includes a die holder 70, a die 72 and a press frame 74. The bottom structure 52 is stationary.

The die holder 70 is attached to, and extends upwardly from, the press frame 74. The die 72 is seated within the die holder 70. The die holder 70 and the die 72 each have a passageway 76, 78, respectively, therethrough which are aligned with each other. The press frame 74 includes a chute 80 therethrough which is in communication with the passageways 76, 78 through the die holder 70 and die 72. The passageways 76, 78 through the die holder 70 and die 72 are aligned with the bore 64 through the stripper plate 62.

In FIG. 1, the punching apparatus 48 is shown disengaged from the composite plate 20*a* which is to be punched. The composite plate 20*a* is placed on top of the bottom structure 52 of the punching apparatus 48, and thus below the top structure 50 of the punching apparatus 48.

Figure 2:
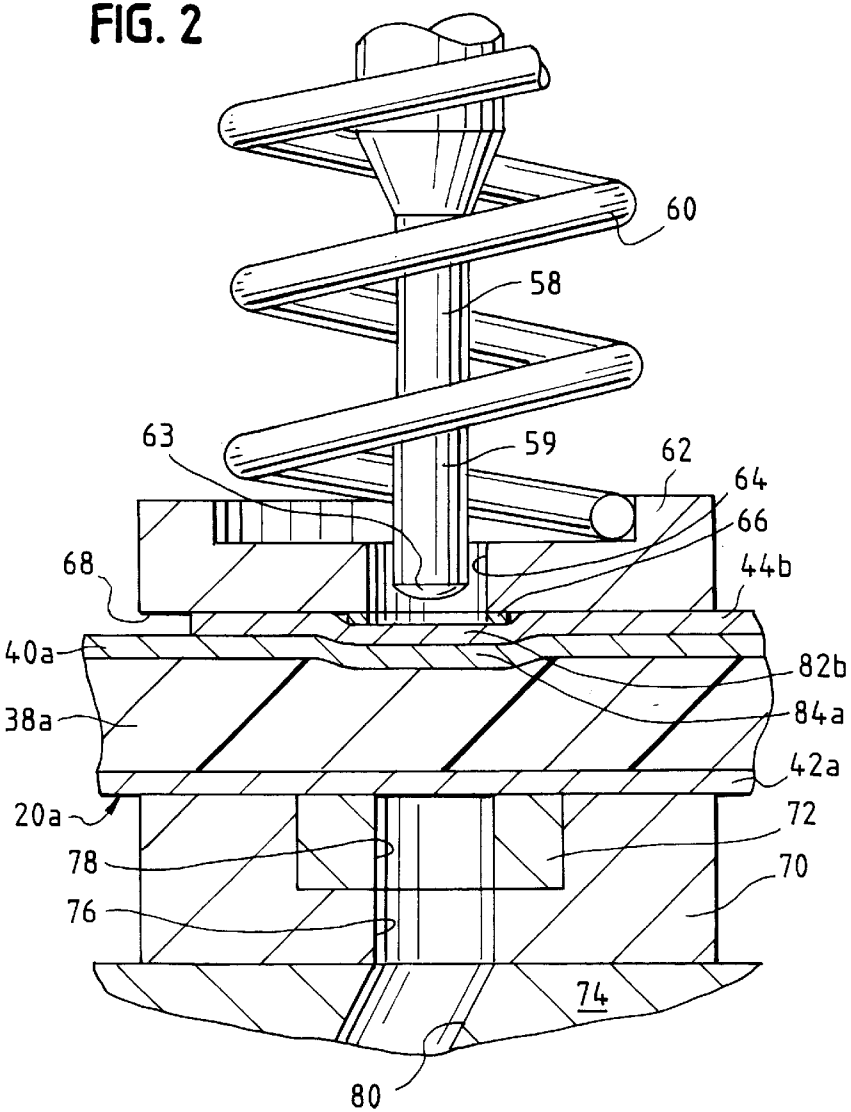

As shown in FIG. 2, the punching apparatus 48 is engaged with the composite plate 20*a* and the skin extension 44*b*, but prior to the punch 58 being passed through the skin extension 44*b* and the first skin 40*a* of the composite plate 20*a*. The lower surface of the second skin 42*a* of the plate 20*a* rests on the die holder 70 and die 72. The stripper plate 62, with the embossment 66, is brought into contact with the upper surface of the skin extension 44*b* by moving the top structure 50 downwardly toward the bottom structure 52.

As the press ram 54 pushes the stripper plate 62 down onto the skin extension 44*b*, pressure is applied to the composite plate 20*a* which causes the core 38*a* of the composite plate 20*a* to compress. For example, the punching apparatus 48 applies 6,000 pounds of pressure on the composite plate 20*a*. The embossment 66 presses against the skin extension 44*b* and causes a portion 82*b*, 84*a* of each of the skin extension 44*b* and the first skin 40*a* and a portion of the core 38*a* to slightly deform around the embossment 66. The inward deformation of portions 82*b*, 84*a* of the skin extension 44*b*, and the first skin 40*a* are exaggerated for clarity in showing the deformation in FIGS. 2–11 and 20–22. If the composite plate 20*a* is being punched through a portion where the skin extension 44*b* is not present or if a portion of the overlap joint 46 which is formed by the composite plate 20*b* is being punched, the embossment 66 presses against the first skin 40*a*, 40*b*, respectively, of the composite plate 20*a*, 20*b*.

Figure 3:
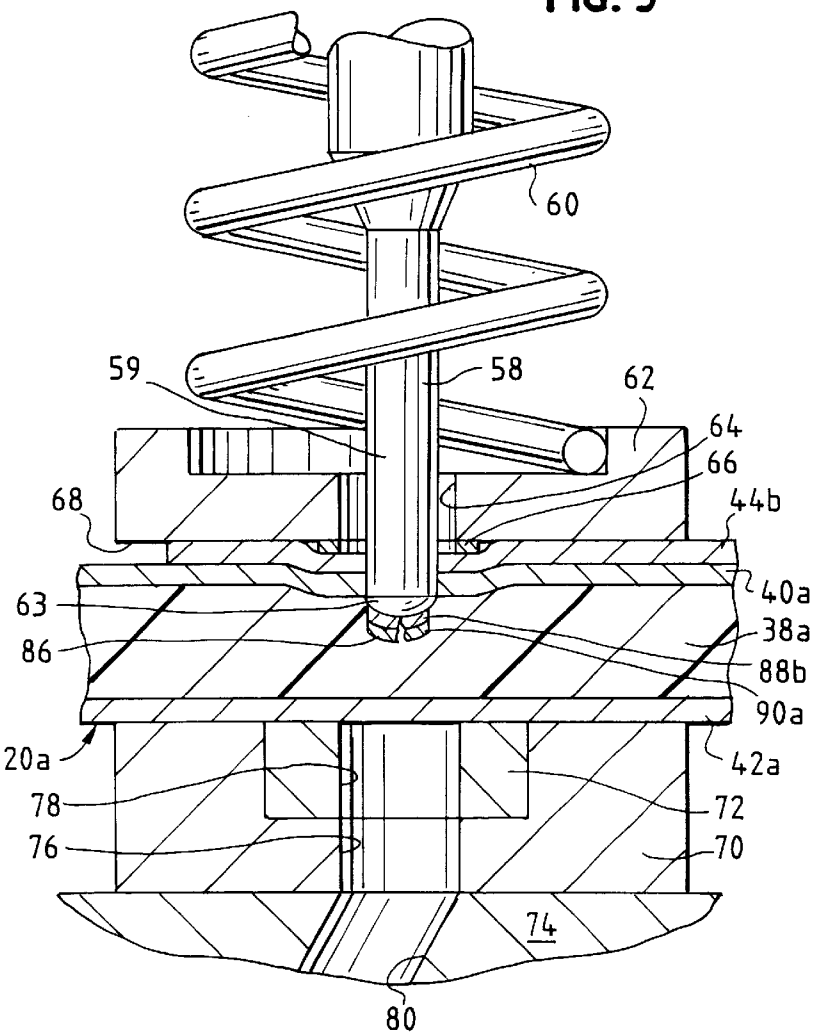

To punch the composite plate 20*a*, as shown in FIG. 3, the press ram 54 continues its downward movement which causes the punch 58 to punch through and break the skin extension 44*b* and the first skin 40*a* once the spring constant of the spring 60 is overcome. After the punch 58 breaks through the skin extension 44*b* and the first skin 40*a* of the composite plate 20*a*, the curved punch tip 63 forms a slug 86. Due to the tip 63 of the punch 58 being curved, the slug 86 that is formed is also curved. The slug 86 is formed of a broken piece 88*b* of the skin extension 44*b* and a broken piece 90*a* of the first skin 40*a* of the composite plate 20*a*. The slug 86 is compressed into the core 38*a* by the punch 58. The punch 58 is used only to break the skin extension 44*b* and first skin 40*a* to form a hole 92 through the skin extension 44*b* and first skin 40*a* and depress a slug 86 slightly into the core 38*a*. The slug 86 has a diameter that is smaller than that of the hole 92 due to its curved nature. Since the slug 86 has a smaller diameter than the hole 92, the ejection of the slug 86 from the composite plate 20*a*, as described herein, will meet less resistance than if the diameter of the slug 86 were substantially equivalent to the diameter of the hole 92. Because the slug 86 is ejected from the composite plate 20*a* with little resistance, there is less opportunity to possibly damage the composite plate 20*a* or the skin extension 44*b* during the ejection of the slug 86.

As the punch 58 passes through the skin extension 44*b* and the first skin 40*a*, the punch 58 deforms the skin extension 44*b* and the first skin 40*a* slightly by causing the portion 82*b*, 84*a* of each of the skin extension 44*b* and the first skin 40*a* around the break caused by the punch 58 to bend slightly inward toward the core 38*a*.

Figure 4:
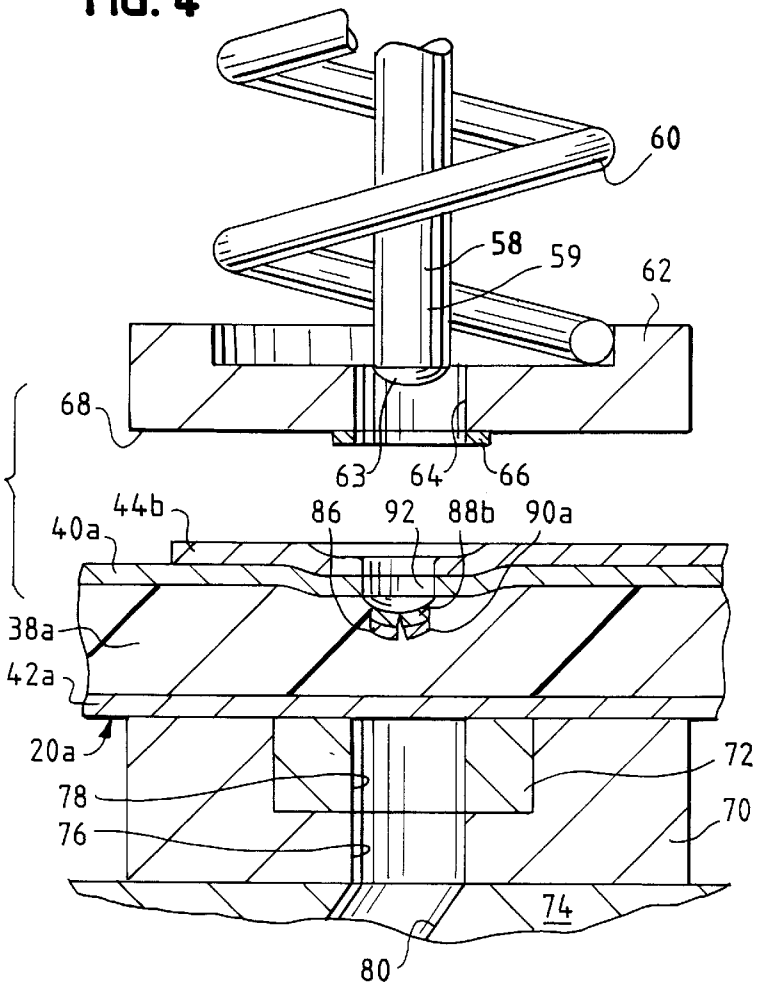

Thereafter, the punch 58 is removed from its engagement through the skin extension 44*b* and the first skin 40*a* of the composite plate 20*a*, such that the pressure from the top structure 50 is removed, leaving the hole 92 through the skin extension 44*b* and the first skin 40*a* as shown in FIG. 4. As the press ram 54 moves upwardly, the spring 60 expands.

Figure 5:
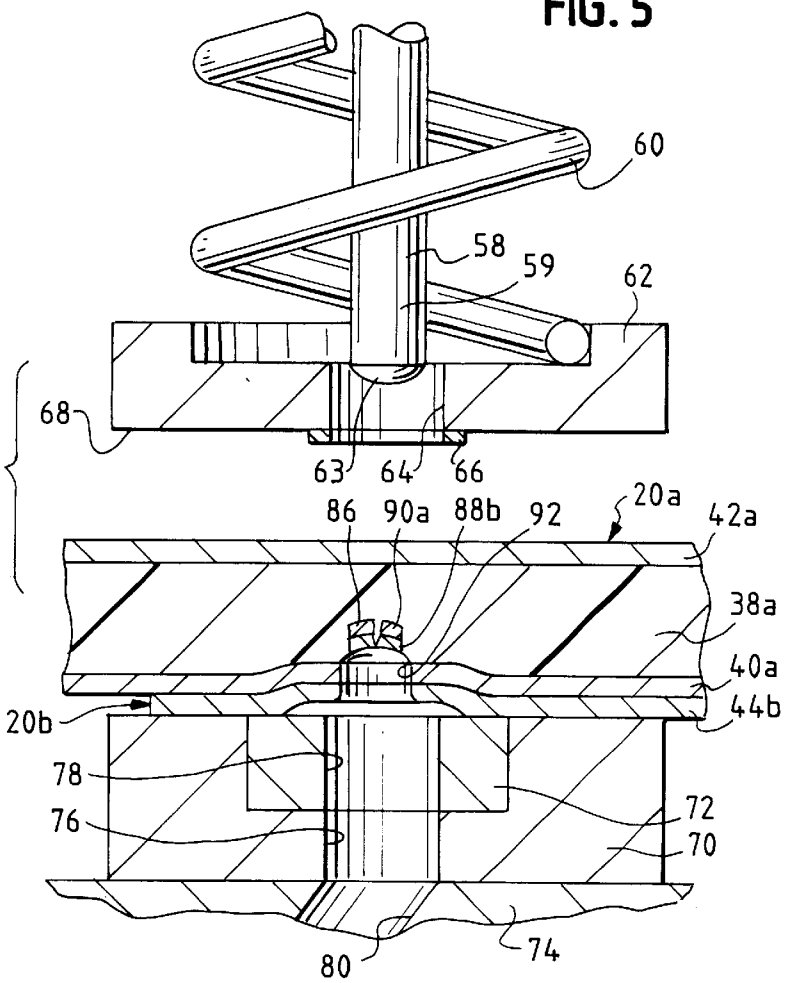

As shown in FIG. 5, after the punch 58 and the stripper plate 62 are withdrawn from engagement with the composite plate 20*a*, the composite plates 20*a*, 20*b* are flipped over so that the second skin 42*a* of the composite plate 20*a* is presented to the punch 58. The composite plate 20*a* is positioned such that the hole 92 in composite plate 20*a* sits over the passageways 76, 78 of the die holder 70 and the die 72 respectively and is aligned with the punch 58.

Figure 6:
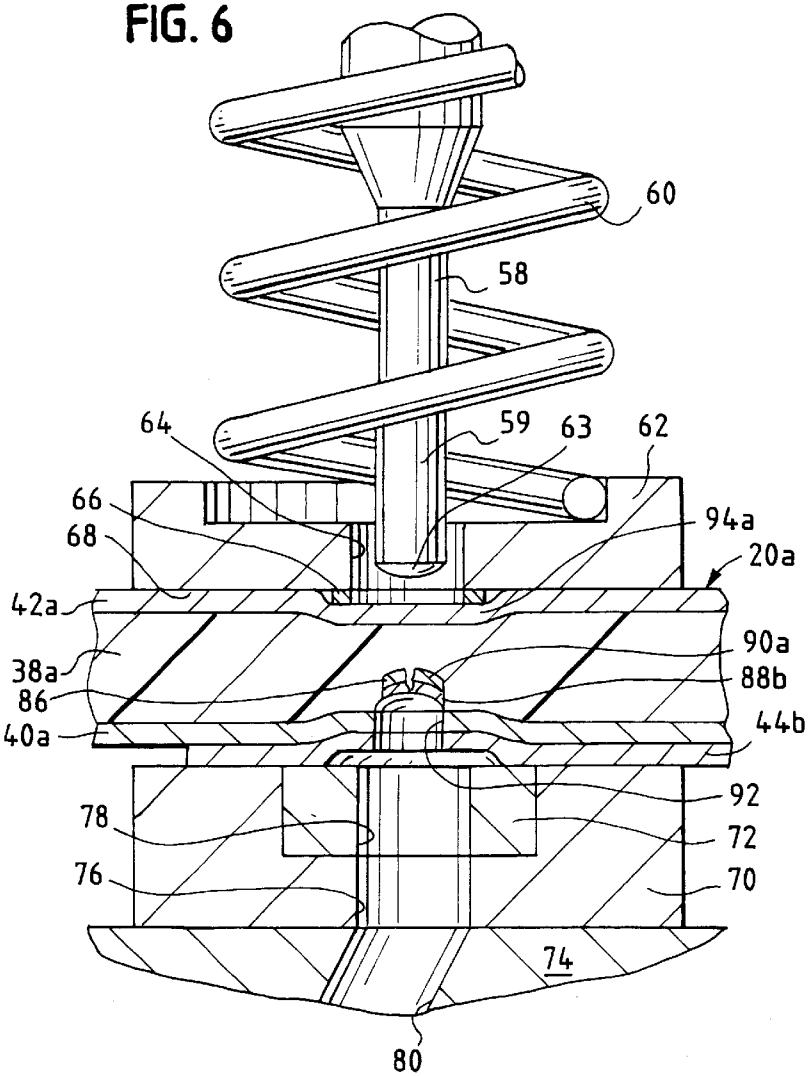

As shown in FIG. 6, the punching apparatus 48 is engaged with the second skin 42*a* of the composite plate 20*a*, but prior to the punch 58 being passed through the second skin 42*a* of the composite plate 20*a*. The upper surface of the skin extension 44*b* of the plate 20*b* rests on the die holder 70 and die 72. The stripper plate 62, with the embossment 66, is brought into contact with the lower surface of the second skin 42*a* by moving the top structure 50 downwardly toward the bottom structure 52.

As the press ram 54 pushes the stripper plate 62 down onto the second skin 42*a*, pressure is applied to the composite plate 20*a* which causes the core 38*a* of the composite plate 20*a* to compress. The embossment 66 presses against the second skin 42*a* of the composite plate 20*a* and causes a portion 94*a* of the second skin 42*a* and a portion of the core 38*a* to slightly deform around the embossment 66. The inward deformation of portion 94*a* of the second skin 42*a* is exaggerated for clarity in showing the deformation in FIGS. 6–11 and 20–22.

Figure 7:
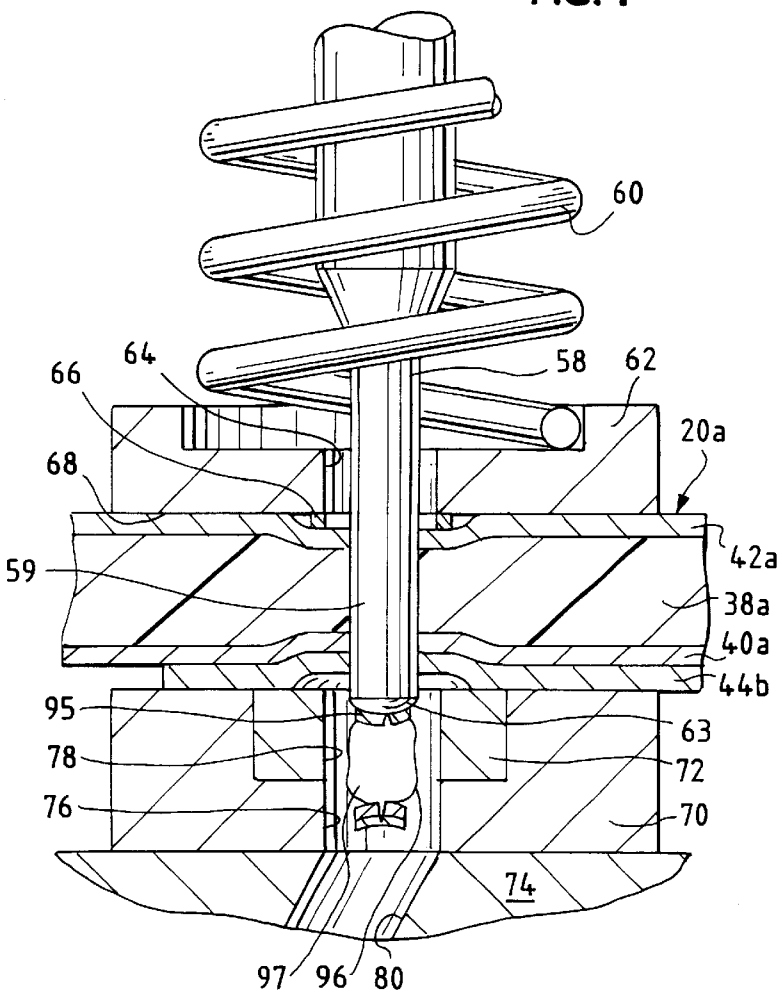

The press ram 54 continues its downward movement, as shown in FIG. 7, which causes the punch 58 to punch through and break the second skin 42*a* once the spring constant of the spring 60 is overcome. As the punch 58 passes and breaks through the second skin 42*a*, the punch 58 deforms the second skin 42*a* slightly by causing the portion 94*a* of the second skin 42*a* around the break caused by the punch 58 to bend slightly inward toward the core 38*a*.

After the punch 58 breaks through the second skin 42*a* of the composite plate 20*a*, a second skin slug 95 is formed.

The core 38*a* is then compressed and displaced outwardly from the punch 58 as the punch enters the core 38*a*. As the punch 58 passes through the core 38*a* of the plate, a slug 96 is pushed through the core 38*a*. The slug 96 is formed of the second skin slug 95, the slug 86 and a portion 97 of the core 38*a* therebetween. Due to the tip 63 of the punch 58 being curved, the second skin slug 95 that is a part of slug 96 is also curved. Therefore, the slug 96 has a diameter that is smaller than that of a hole 98 that is formed by the punch 58 due to the curved nature of the slug 96. Since the slug 96 has a smaller diameter than the hole 98, the ejection of the slug 96 from the composite plate 20*a*, as described herein, will meet less resistance than if the diameter of the slug 96 were substantially equivalent to the diameter of the hole 98. Because the slug 96 is ejected from the composite plate 20*a* with little resistance, there is less opportunity to possibly damage the composite plate 20*a* or the skin extension 44*b* during the ejection of the slug 96. When the punch 58 reaches the first skin 40*a* of the composite plate 20*a* the core 38*a* has been displaced outward around the punch penetration area.

As the punch 58 passes through the first skin 40*a* and the skin extension 44*b* where the hole 92 was formed, the slug 96 is deposited into the passageway 78 through the die 72. The slug 96 passes through the passageways 76, 78 in the die holder 70 and die 72 and then downwardly through the chute 80 in the press frame 74 to a collection area (not shown).

Figure 8:
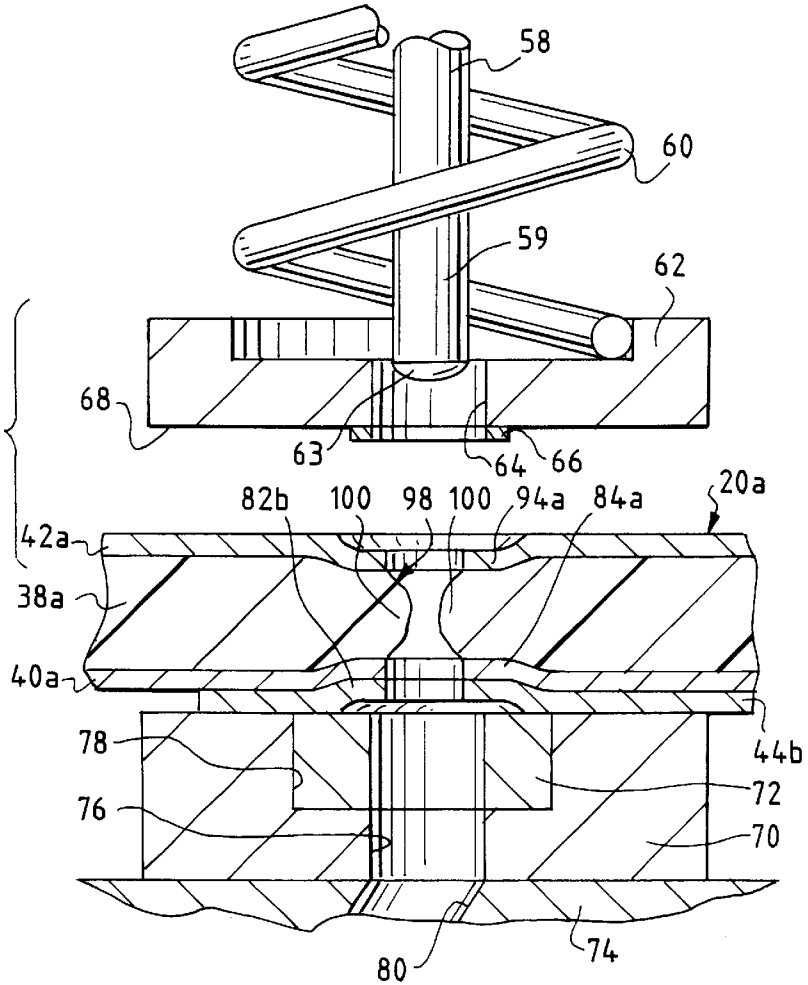

Thereafter, the punch 58 is removed from its engagement through the composite plate 20*a*. As the press ram 54 moves upwardly, the spring 60 expands. The punching apparatus 48 is disengaged from the composite plate 20*a* such that the punch 58 and the stripper plate 62 are withdrawn from engagement with the composite plate 20*a* and the hole 98 is formed, as shown in FIG. 8. Due to the resiliency of the core material, a portion 100 of the core material springs back into the hole 98 when the punch 58 is removed in such a manner so as to partially block the punched hole 98 through the plate 20*a*, 20*b*, respectively. Therefore, at this time, a rivet cannot be placed through the hole 98 due to the core material 100 which interferes with the hole 98. If the method used in the prior art were employed here, a separate tool would now be used to drill out the interfering material 100 in the punched hole 98.

The inner wall 102 of hole 98 is convex such that the interfering core material 100 protrudes inwardly toward the center of the hole 98 after the punching apparatus 48 has punched entirely through the composite plate 20*a*, 20*b*. For example, the interfering core material 100 can form a minimum diameter in the hole 98 of one hundred and eighty-five thousands of an inch when the punch 58 has a diameter of two hundred and sixty-five thousands of an inch. Of course, the amount of springback is dependent on the amount of pressure placed on the composite plate 20*a*, 20*b* when the plate 20*a*, 20*b* is compressed by the punching apparatus 48 and the thickness of the core material.

Figure 9:
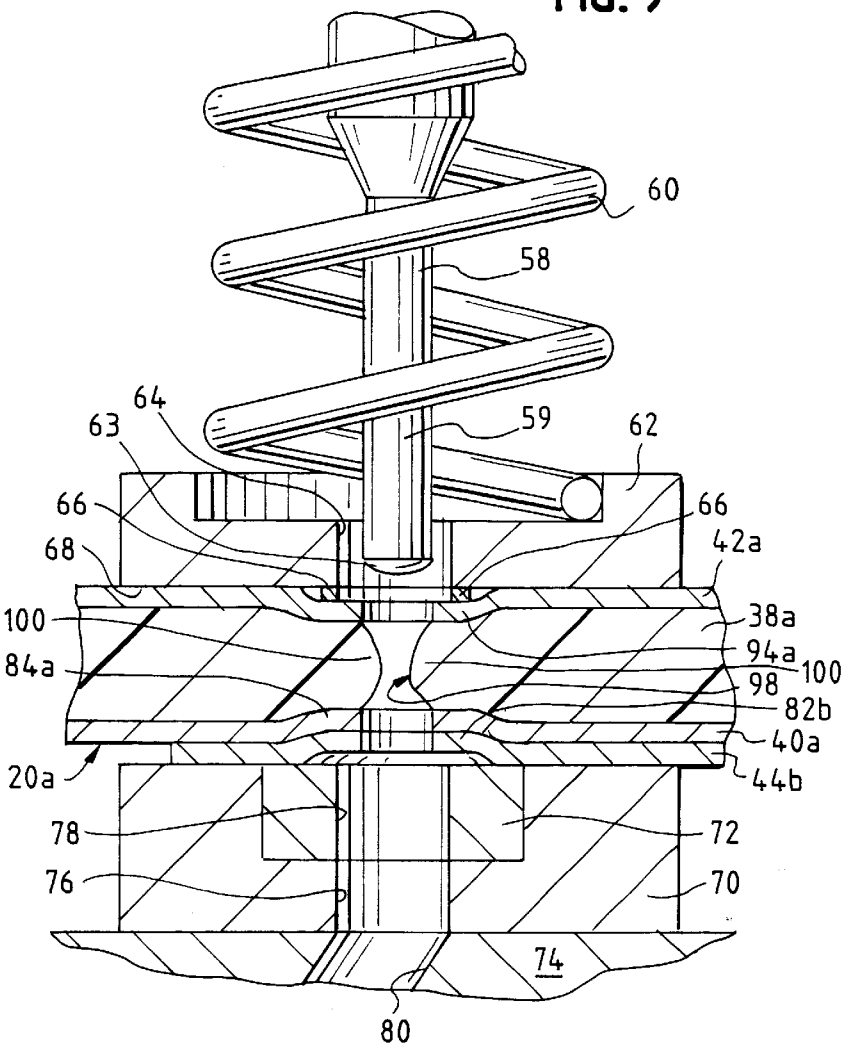

To clear the area through the hole 98 so that a rivet may be passed therethrough, the composite plate 20*a* is punched again by the punching apparatus 48 through the same area as where the hole 98 is first punched. As shown in FIG. 9, the stripper plate 62, with embossment 66, is once again pressed against the second skin 42*a* to compress the core 38*a* of the composite plate 20*a*. When the stripper plate 62 applies pressure to the composite plate 20*a*, the core 38*a* is again compressed and core material around the hole 98 is moved into the hole 98 due to the pressure on the composite plate 20*a* by the punching apparatus 48. Depending on the amount of compression on the core 38*a*, more core material than just the interfering material 100 may be moved into the hole area. At this point, the punch 58 is not engaged with the composite plate 20*a*.

Figure 10:
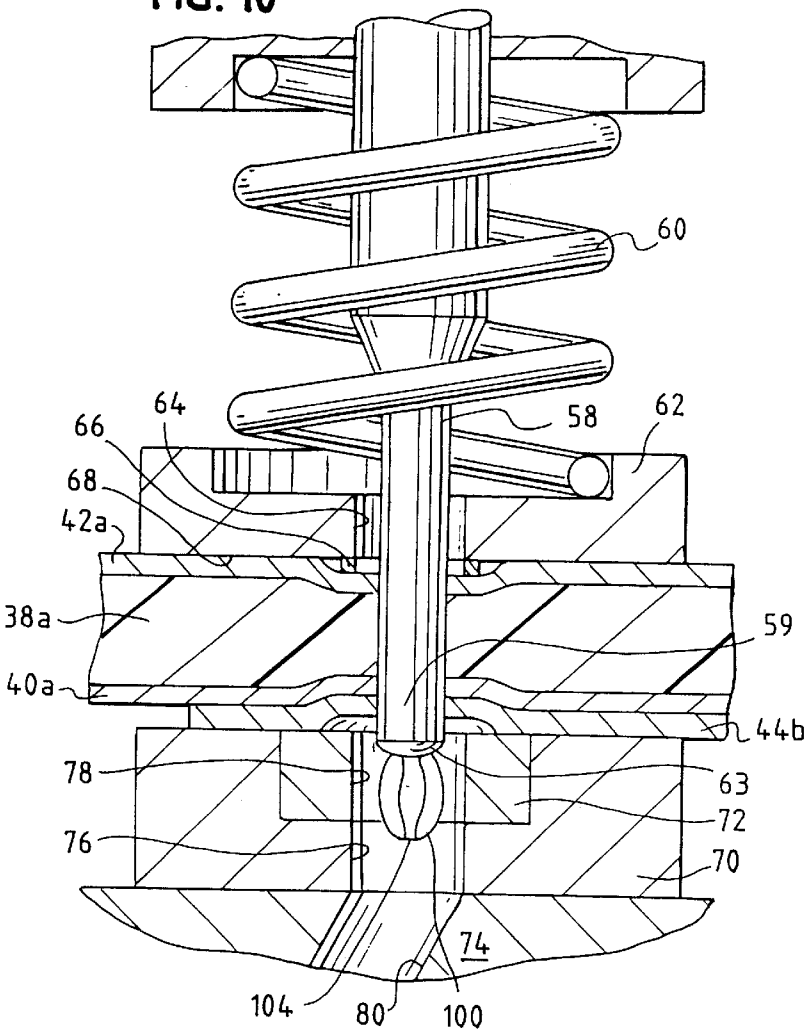

Thereafter, as shown in FIG. 10, the punch 58 is passed through the composite plate 20*a* in a manner similar to that as described hereinabove. Of course, the punch 58 does not have to penetrate through the skin extension 44*b* and the first and second skins 40*a*, 42*a* because the punch 58 is being passed through the same hole 98 already formed by the previous punch. When the punch 58 passes through the plate 20*a*, the punch 58 shears the core material 100 that interferes with the punch 58 as it penetrates through the hole 98 for the second time. The slug 104 that is formed by this punch passes through the passageways 76, 78 and through the chute 80 to the collection area.

Figure 11:
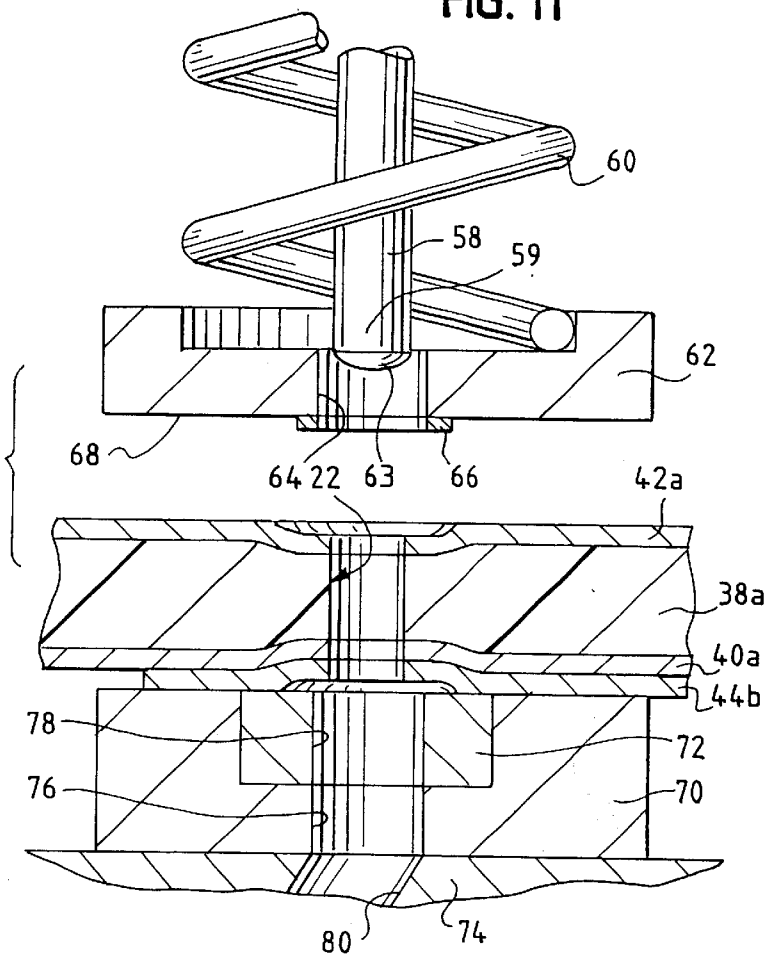

Next, as shown in FIG. 11, the punching apparatus 48 is withdrawn from the composite plate 20*a*, as described hereinabove. Some of the core material may spring back into the hole area, however, it is not sufficient to interfere with the clear hole 22 formed through the plate 20*a*.

Depending on the amount of material moved into the hole area because of the pressure placed on the core 38*a*, while the pressure from the top structure 50 is being placed on the composite plate 20*a* and after the punch 58 has completely penetrated the plate 20*a*, the core material around the hole area may be generally concave, that is, the inner wall of the hole 22 is concave outwardly from the center of the hole 22. If this occurs, when the pressure on the composite plate 20*a* by the punching apparatus 48 is removed and the core material 38*a* springs back into the hole area, the core material 38*a* does not spring back far enough so as to enter into the hole 22.

Attention is now directed to the second embodiment of the method shown in FIGS. 12–19 which is used to form a hole 22' which is clear of interfering material. The punching apparatus 48' used in this embodiment of the method is identical to that of the first embodiment, except that the end of the punch 58' has an enlarged shoulder 107' at the end thereof. That is, the punch 58' includes a shaft 59' which has an enlarged shoulder 107' of a larger diameter than the shaft 59' at the end thereof. The same reference numerals are used to denote like elements in the first and second embodiments, with a prime being provided after the reference numbers denoted in the second embodiments.

Figure 12:
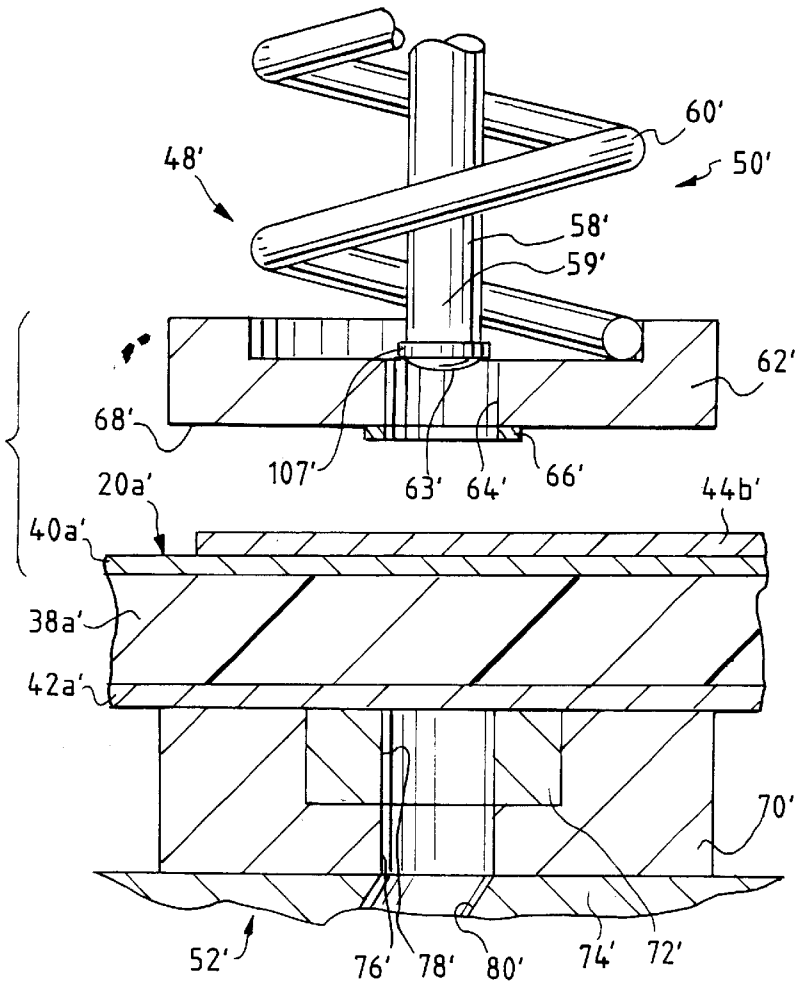

In FIG. 12, the punching apparatus 48' is shown disengaged from the composite plate 20*a'* which is to be punched. The composite plate 20*a'* is placed on top of the bottom structure 52' of the punching apparatus 48', and thus below the top structure 50' of the punching apparatus 48'.

Figure 13:
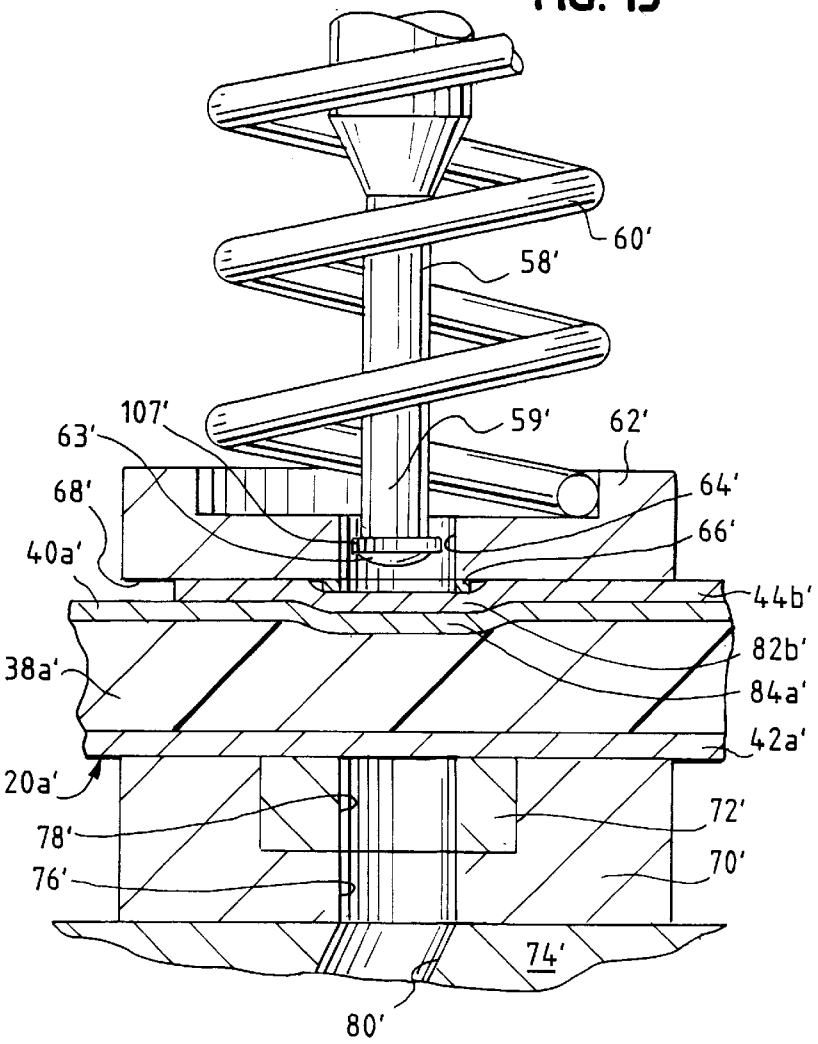
FIGS. 12–19 are cross-sectional views that display the method of punching a clear hole through a composite plate as described in the second embodiment.

As shown in FIG. 13, the punching apparatus 48' is engaged with the composite plate 20*a'* and the skin extension 44*b'*, but prior to the punch 58' being passed through the skin extension 44*b'* and the first skin 40*a'* of the composite plate 20*a'*. The lower surface of the second skin 42*a'* of the plate 20*a'* rests on the die holder 70' and die 72'. The stripper plate 62', with the embossment 66', is brought into contact with the upper surface of the skin extension 44*b'* by moving the top structure 50' downwardly toward the bottom structure 52'.

As the press ram 54' pushes the stripper plate 62' down onto the skin extension 44*b'*, pressure is applied to the composite plate 20*a'* which causes the core 38*a'* of the composite plate 20*a'* to compress. For example, the punching apparatus 48' applies 6,000 pounds of pressure on the composite plate 20*a'*. The embossment 66' presses against the skin extension 44*b'* and causes a portion 82*b'*, 84*a'* of each of the skin extension 44*b*' and the first skin 40*a*' and a portion of the core 38*a*' to slightly deform around the embossment 66'. The inward deformation of portions 82*b*', 84*a*' of the skin extension 44*b*' and the first skin 40*a*' are exaggerated for clarity in showing the deformation in FIGS. 13–22. If the composite plate 20*a*' is being punched through a portion where the skin extension 44*b*' is not present or if a portion of the overlap joint 46' which is formed by the composite plate 20*b*' is being punched, the embossment 66' presses against the first skin 40*a*', 40*b*', respectively, of the composite plate 20*a*', 20*b*'.

Figure 14:
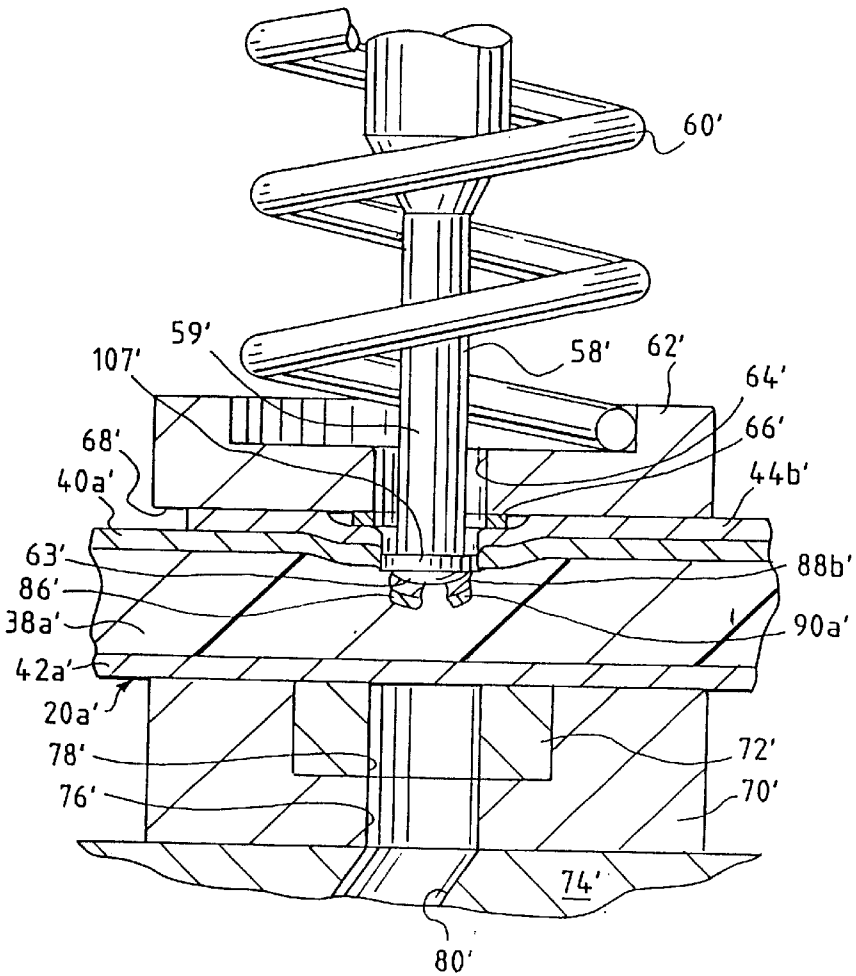

To punch the composite plate 20*a*', as shown in FIG. 14, the press ram 54' continues its downward movement which causes the punch 58' to punch through and break the skin extension 44*b*, and the first skin 40*a*' once the spring constant of the spring 60' is overcome. After the punch 58' breaks through the skin extension 44*b*' and the first skin 40*a*' of the composite plate 20*a*', the curved punch tip 63' forms a slug 86'. Due to the tip 63' of the punch 58' being curved, the slug 86' that is formed is also curved. The slug 86' is formed of a broken piece 88*b*' of the skin extension 44*b*' and a broken piece 90*a*' of the first skin 40*a*' of the composite plate 20*a*'. The slug 86' is compressed into the core 38*a*' by the punch 58'. The punch 58' is used only to break the skin extension 44*b*' and first skin 40*a*' to form a hole 92' through the skin extension 44*b*' and first skin 40*a*' and depress the slug 86' slightly into the core 38*a*'. The slug 86' has a diameter that is smaller than that of the hole 92' due to its curved nature. Since the slug 86' has a smaller diameter than the hole 92', the ejection of the slug 86' from the composite plate 20*a*', as described herein, will meet less resistance than if the diameter of the slug 86' were substantially equivalent to the diameter of the hole 92'. Because the slug 86' is ejected from the composite plate 20*a*' with little resistance, there is less opportunity to possibly damage the composite plate 20*a*' or the skin extension 44*b*' during the ejection of the slug 86'.

As the punch 58' passes and breaks through the skin extension 44*b*' and the first skin 40*a*', the punch 58' deforms the skin extension 44*b*' and the first skin 40*a*' slightly by causing the portion 82*b*', 84*a*' of each of the skin extension 44*b*' and the first skin 40*a*' around the break caused by the punch 58' to bend slightly inward toward the core 38*a*'.

Figure 15:
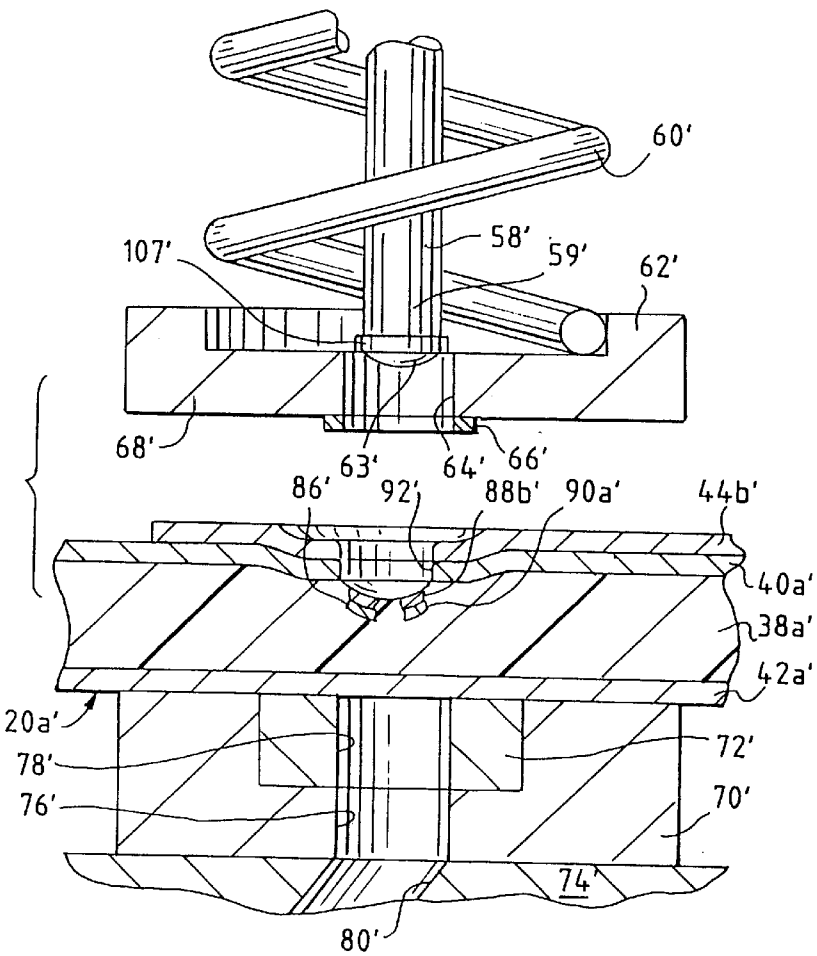

Thereafter, the punch 58' is removed from its engagement through the skin extension 44*b*' and the first skin 40*a*' of the composite plate 20*a*', such that the pressure from the top structure 50' is removed, leaving the hole 92' as shown in FIG. 15. As the press ram 54' moves upwardly, the spring 60' expands.

Figure 16:
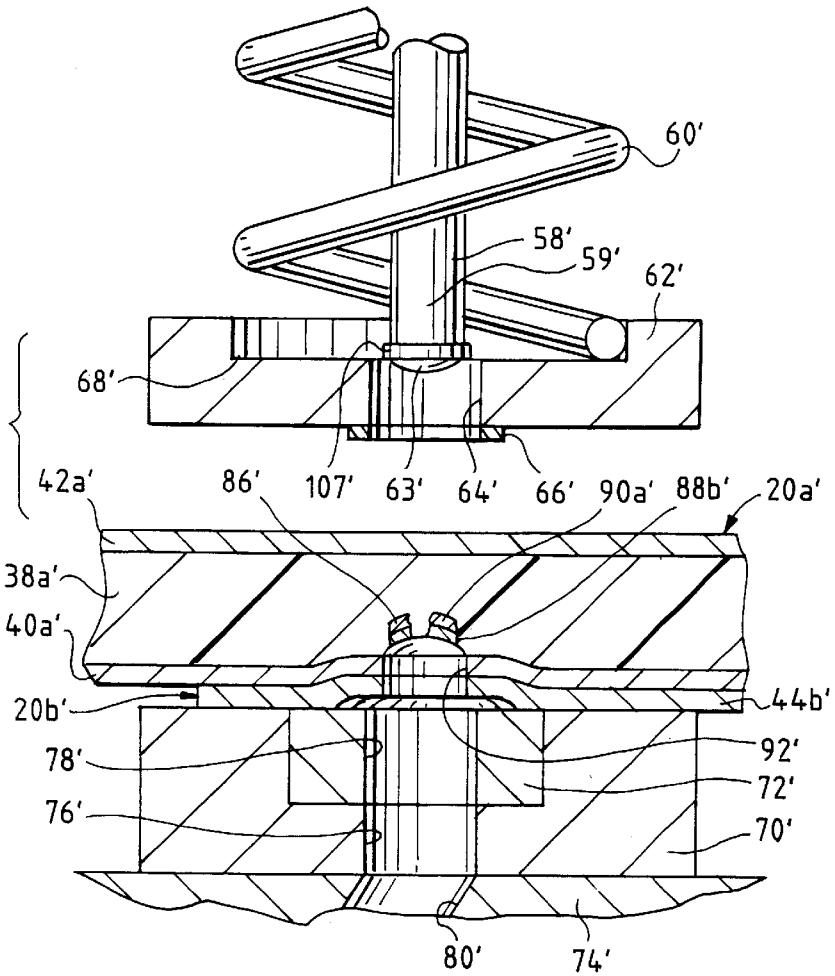

As shown in FIG. 16, after the punch 58' and the stripper plate 62' are withdrawn from engagement with the composite plate 20*a*', the composite plates 20*a*', 20*b*' are flipped over so that the second skin 42*a*' of the composite plate 20*a*' is presented to the punch 58'. The composite plate 20*a*' is positioned such that the hole 92' in the composite plate 20*a*' sits over the passageways 76', 78' of the die holder 70' and the die 72' respectively and is aligned with the punch 58'.

Figure 17:
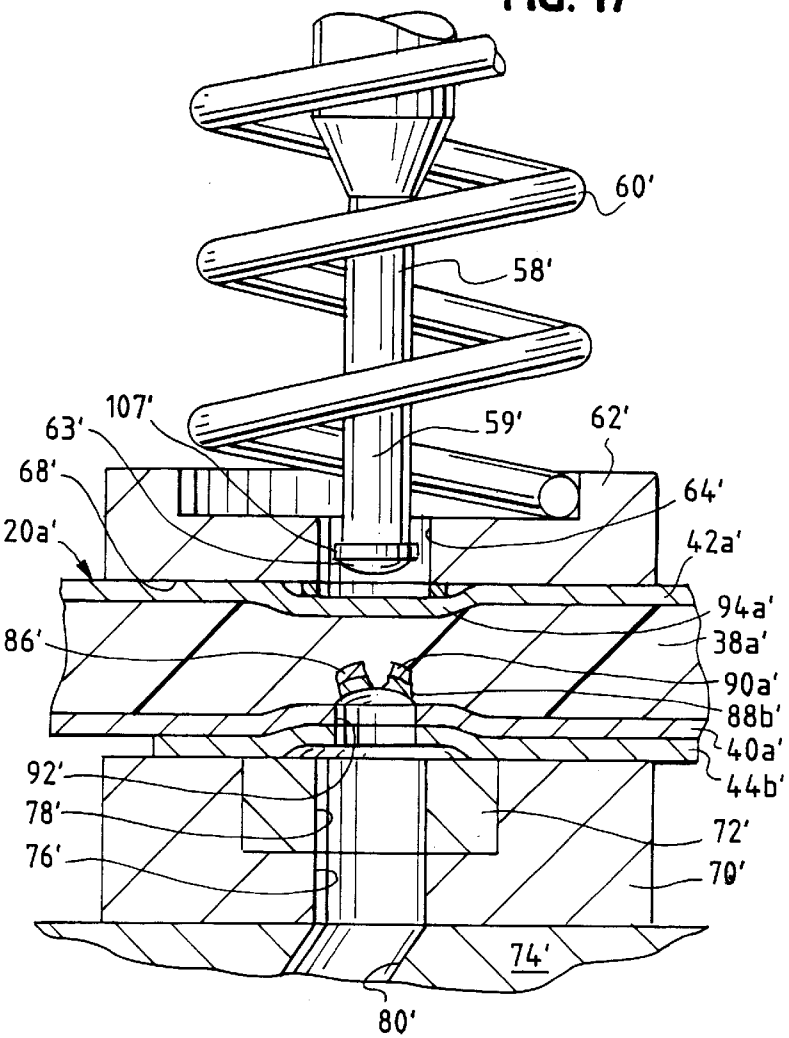

As shown in FIG. 17, the punching apparatus 48' is engaged with the second skin 42*a*' of the composite plate 20*a*', but prior to the punch 58' being passed through the second skin 42*a*' of the composite plate 20*a*'. The upper surface of the skin extension 44*b*' of the plate 20*b*' rests on the die holder 70' and die 72'. The stripper plate 62', with the embossment 66', is brought into contact with the lower surface of the second skin 42*a*' by moving the top structure 50' downwardly toward the bottom structure 52'.

As the press ram 54' pushes the stripper plate 62' down onto the second skin 42*a*', pressure is applied to the composite plate 20*a*' which causes the core 38*a*' of the composite plate 20*a*' to compress. The embossment 66' presses against the second skin 42*a*' of the composite plate 20*a*' and causes a portion 94*a*' of the second skin 42*a*' and a portion of the core 38*a*' to slightly deform around the embossment 66'. The inward deformation of portion 94*a*' of the second skin 42*a*' are exaggerated for clarity in showing the deformation in FIGS. 17–22.

Figure 18:
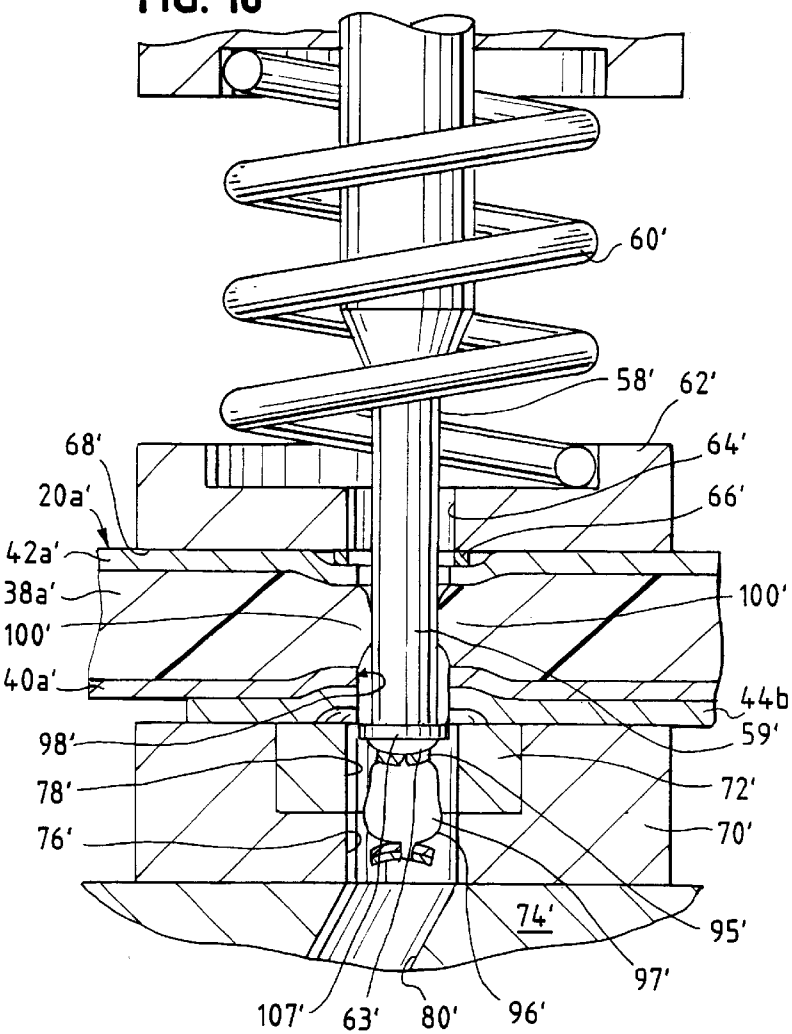

The press ram 54' continues its downward movement, as shown in FIG. 18, which causes the punch 58' to punch through and break the second skin 42*a*' once the spring constant of the spring 60' is overcome. As the punch 58' passes and breaks through the second skin 42*a*', the punch 58' deforms the second skin 42*a*' slightly by causing the portion 94*a*' of the second skin 42*a*' around the break caused by the punch 58' to bend slightly inward toward the core 38*a*.

After the punch 58' breaks through the second skin 42*a*' of the composite plate 20*a*', a second skin slug 95' is formed. The core 38*a*' is then compressed and displaced outwardly from the punch 58' as the punch enters the core 38*a*'. As the punch 58' passes through the core 38*a*' of the plate, a slug 96' is pushed through the core 38*a*'. The slug 96' is formed of the second skin slug 95', the slug 86' and a portion 97' of the core 38*a* ' therebetween. Due to the tip 63' of the punch 58' being curved, the second skin slug 95' that is a part of the slug 96' is also curved. Therefore, the slug 96' has a diameter that is smaller than that of a hole 98' that is formed by the punch 58' due to the curved nature of the slug 96'. Since the slug 96' has a smaller diameter than the hole 98', the ejection of the slug 96' from the composite plate 20*a*', as described herein, will meet less resistance than if the diameter of the slug 96' were substantially equivalent to the diameter of the hole 98'. Because the slug 96' is ejected from the composite plate 20*a*' with little resistance, there is less opportunity to possibly damage the composite plate 20*a*' or the skin extension 44*b*' during the ejection of the slug 96'. When the punch 58' reaches the first skin 40*a*' of the composite plate 20*a*' the core 38*a*' has been displaced outward around the punch penetration area.

As the punch 58' passes through the first skin 40*a*' and the skin extension 44*b*' where the hole 92' was formed, the slug 96' is deposited into the passageway 78' through the die 72'. The slug 96' passes through the passageways 76', 78' in the die holder 70' and die 72' and then downwardly through the chute 80' in the press frame 74' to a collection area (not shown). The punch 58' creates the hole 98'.

While the punch 58' is passing through the plate 20*a*' and the skin extension 44*b*', depositing the slug 96' into the passageway 78', a portion 100' of the core material 38*a*' springs back, behind the shoulder 107', into the hole 98' created by the punch 58' due to the resiliency of the core material. The core material 38*a*' is able to expand into the hole 98', behind the shoulder 107', due to the difference in the diameters of the shoulder 107' and the shaft 59' of the punch 58'. The diameter of the shoulder 107' is greater than the diameter of the shaft 59' of the punch 58'. Therefore, the diameter of the hole 98' is the substantially equivalent to that of the shoulder 107', and larger than the diameter of the shaft 59' of the punch 58'. Thus, when the shaft 59' of the punch 58' is positioned within the hole 98', there is extra space within the hole 98' not occupied by the shaft 59' of the punch 58', where the core material 38*a*' may expand to.

Figure 19:
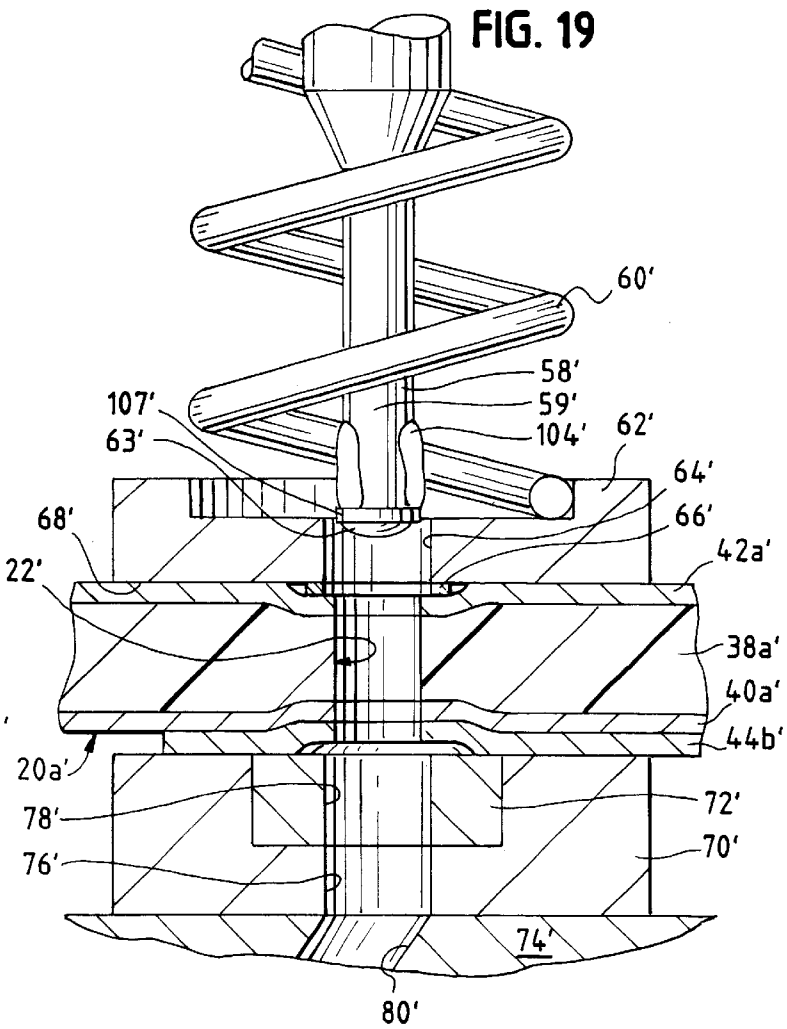

As shown in FIG. 19, when the punch 58' is removed from its engagement through the composite plate 20*a*', the portion 100' of the core material 38*a*' that sprung back into the hole 98' comes into contact with the shoulder 107' that is provided for on the punch 58'. As the punch 58' is removed from engagement with the composite plate 20*a*', the shoulder 107' of the punch 58' shears the portion 100' of the core material 38*a*' that interferes with the shoulder 107' as the shoulder 107' again passes through the hole 98'. The slug 104' that is formed by the shoulder 107' during the disengagement of the punch 58' can then be removed by suitable means.

After the punch 58' is withdrawn from the composite plate 20*a*', some of the core material 38*a*' may spring back into the hole area, however, it is not sufficient to interfere with the clear hole 22' formed through the plate 20*a*'.

Depending on the amount of material moved into the hole area because of the pressure placed on the core 38*a*', while the pressure from the top structure 50' is being placed on the composite plate 20*a*' and after the punch 58' has completely penetrated the plate 20*a*', the core material around the hole area may be generally concave, that is, the inner wall of the hole 22' is concave outwardly from the center of the hole 22'. If this occurs, when the pressure on the composite plate 20*a*' by the punching apparatus 48' is removed and the core material 38*a*' springs back into the hole area, the core material 38*a*' does not spring back far enough so as to enter the hole 22'.

Figure 20:
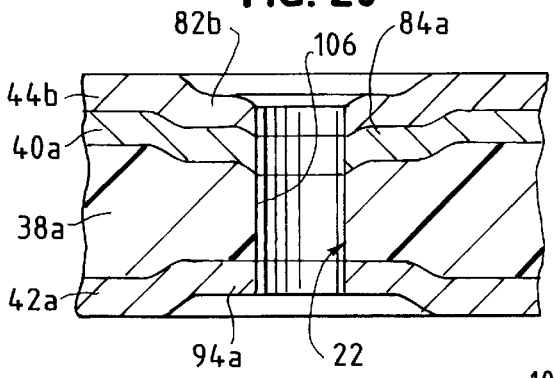
FIG. 20 is an enlarged, cross-sectional view of the clear hole formed by the punching apparatus.
Figure 21:
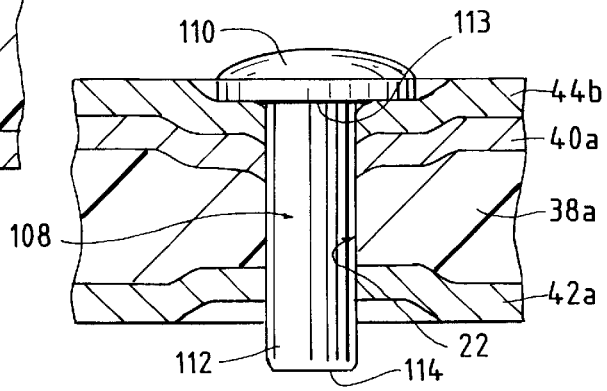
FIG. 21 is a cross-sectional view of the composite plate with a rivet, shown in elevation, inserted through the clear hole formed by the punching apparatus.

FIG. 20 shows the clear punched hole formed by each embodiment of the method through the composite plate 20*a* and the skin extension 44*b*. For convenience in explanation, FIGS. 20, 21, & 22 are shown and described using the reference numerals of the first embodiment. The inner wall 106 of the hole 22 formed after the last punch in accordance with the present method is generally straight. The portions 82*b*, 84*a*, 94*a* of the skins 44*b*, 40*a*, 42*a* around the hole area are deformed (shown exaggerated) and the portion of the core 38*a* around the hole area is compressed. It is to be understood that the inner walls of the holes through other portions of the composite plates 20*a*, 20*b* that do not have the skin extension 44*b* are also generally straight after being punched in accordance with the novel method described herein.

Thereafter, as shown in FIG. 21, a rivet 108, which is formed of an elongated shank 112 having a first end 113 and a second end 114, and a head 110 at the first end 113 of the shank 112. The rivet 108 may easily passed through the clear, punched hole 22 in the composite plate 20*a* (or plate 20*b*). Because of the formation of the downward deformation of the first skin extension 44*b* (or the first skin 40*a*, 40*b* if that portion is punched) by the embossment 66, the edges of the rivet head 110 sit beneath the upper surface of the skin extension 44*b* (or the first skin 40*a*, 40*b*). This prevents or at least minimizes the possibility of an article snagging the edge of the rivet head 110 which could cause the rivet head 110 to shear off of the shank 112. As shown in FIG. 22, the second end 114 of the rivet 108 is swaged and enlarged or upset to secure the rivet 108 to the plate 20*a*.

If any irregularities are formed along the inner wall 106 of the hole 22 during the punching process, a space will be formed between the rivet shank 112 and the inner wall 106 of the hole 22. When the end 114 of the rivet 108 is swaged and enlarged or upset to secure the rivet 108 to the composite plate 20*a*, the rivet shank 112 expands to fill any such spaces so as to provide a tight uniform fit between the rivet shank 112 and the inner wall 106 of the punched hole 22.

Depending on the amount of pressure placed on the composite plate 20*a*, 20*b* by the punching apparatus 48, the inner wall of the hole 22 after being punched, may be slightly convex or concave. If the inner wall 106 of the hole 22 is convex, this aids in forming a tight fit between the rivet shank 112 and the core 38*a*. If the inner wall 106 of the hole 22 is concave, such that the inner wall 106 is undercut the first and second skins 40*a*, 42*a* of the plate 20*a*, when the rivet end 114 is swaged, the rivet shank 112 expands so as to fill any space between the inner wall 106 of the hole 22 and the rivet shank 112.

It is also envisioned that a second punching apparatus could be used in the methods described in the first and second embodiments. The use of a second punching apparatus could obviate the need for flipping over the composite plate and realigning the previously formed hole therein with the punch. The composite plate could either be manually moved to the second punching apparatus and realigned, or the composite plate could rest on a conveyor belt which could move the composite plate from the first punching apparatus to the second punching apparatus, thereby automatically aligning the second punch with the previously formed hole. The use of a second punching apparatus could also obviate the need for resetting the distance that the first punching apparatus will punch through. Since the first punching apparatus punches a shorter distance for the first punch than it does for the second and, if necessary, third punch, the first punching apparatus could punch only the shorter distance while the second punching apparatus could punch the longer distance, i.e., completely through the composite plate.

While preferred embodiments of the present invention are shown and described, it is envisioned that those skilled in the art may devise various modifications of the present invention without departing from the spirit and scope of the appended claims.

The invention claimed is:

1. A method of forming a hole in a composite plate comprising the steps of:

(a) providing a composite plate having a first skin, a second skin and a core of resilient material between said first and second skins;

(b) providing a punching apparatus having a punch;

(c) advancing said punch through said first skin of said composite plate to break said first skin and form a first skin slug and to depress said first skin slug into said core, thereby compressing said core;

(d) withdrawing said punch from said composite plate;

(e) advancing said punch through said second skin to break said second skin and form a second skin slug;

(f) further advancing said punch through said core to break a portion of said core until said first skin slug, said portion of said core, and said second skin slug are ejected from said composite plate to form a hole through said composite plate; and (g) withdrawing said punch from said composite plate.

2. A method as defined in claim 1, wherein step (b) further comprises providing a plate which is selectively engageable with said first skin of said composite plate to apply pressure to said composite plate during step (c); and wherein said plate is selectively engageable with said second skin of said composite plate to apply pressure to said composite plate during steps (e) and (f).

3. A method as defined in claim 1, further including the step of:

(h) re-punching said hole by advancing said punch through said hole to remove any excess core material which has expanded into said hole; and (i) withdrawing said punch from said composite plate for a second time.

4. A method as defined in claim 3, wherein step (b) further comprises providing a plate which is selectively engageable with said first skin of said composite plate to apply pressure to said composite plate during step (c); and wherein said plate is selectively engageable with said second skin of said composite plate to apply pressure to said composite plate during steps (e) and (f).

5. A method as defined in claim 3, wherein step (h) comprises re-applying pressure to said composite plate to re-compress said core and thereafter, re-advancing said punch through said hole formed in step (f) to shear any interfering core material out of said hole.

6. A method as defined in claim 3, wherein said punch has a shaped tip, and wherein said first skin slug formed in step (c) has a reduced diameter relative to said hole, and wherein said second skin slug formed in step (e) has a reduced diameter relative to said hole.

7. A method as defined in claim 1, further including the steps of:

(d1) flipping over said composite plate; and (d2) positioning said flipped composite plate, whereby said punch is in direct alignment with said first skin slug.

8. A method as defined in claim 1, wherein step (c) comprises applying pressure to said composite plate to compress said core and thereafter, advancing said punch through said first skin, and wherein steps (e) and (f) comprise applying pressure to said composite plate to compress said core and thereafter, passing said punch through said composite plate.

9. A method as defined in claim 1, wherein said punch has a shaped tip, and wherein said first skin slug formed in step (c) has a reduced diameter relative to said hole, and wherein said second skin slug formed in step (e) has a reduced diameter relative to said hole.

10. A method as defined in claim 1, wherein said punch provided in step (b) comprises a shaft of a predetermined diameter having a shoulder of a diameter larger than said predetermined diameter of said shaft, said hole formed in step (f) having a diameter approximately equivalent to said diameter of said shoulder.

11. A method as defined in claim 10, further including the step of:

(f1) allowing said core material to expand into said hole after forming said hole in step (f).

12. A method as defined in claim 11, wherein said core material expands behind said shoulder into an area of said hole not occupied by said shaft prior to said punch being withdrawn from said composite plate in step (g).

13. A method as defined in claim 10, wherein said punch has a shaped tip, and wherein said first skin slug formed in step (c) has a reduced diameter relative to said hole, and wherein said second skin slug formed in step (e) has a reduced diameter relative to said hole.

14. A method as defined in claim 1, wherein said punch is advanced in steps (e) and (f) in alignment with said first skin slug formed in step (c).

15. A method as defined in claim 1, wherein said first skin slug formed in step (c) is slightly depressed into said core.

16. A method of forming a joint through adjacent composite plates comprising the steps of:

(a) providing a first composite plate having a first skin, a second skin and a core of resilient material between said first and second skins of said first composite plate;

(b) providing a second composite plate having a first skin, a second skin and a core of resilient material between said first and second skins of said second composite plate;

(c) placing ends of said first and second composite plates adjacent to each other;

(d) providing an overlapping skin which is connected to said first skin of said first composite plate and overlaps said first skin of said second composite plate;

(e) providing a punching apparatus having a punch;

(f) advancing said punch through said first skin of said second composite plate and said overlapping skin to break said first skin of said second composite plate and said overlapping skin and form a first skin-overlapping slug and to depress said first skin-overlapping slug into said core, thereby compressing said core;

(g) withdrawing said punch from said overlapping skin and said first skin of said second composite plate;

(h) advancing said punch through said second skin of said second composite plate to break said second skin of said second composite plate and form a second skin slug;

(i) further advancing said punch through said core of said second composite plate to break a portion of said core of said second composite plate until said first skin-overlapping slug, said portion of said core of said second composite plate and said second skin slug are ejected from said second composite plate to form a hole through said overlapping skin and said second composite plate;

(j) withdrawing said punch from said second composite plate; and (k) placing securing means through said hole to join said first and second composite plates together.

17. A method as defined in claim 16, wherein step (f) comprises applying pressure to said first skin of said second composite plate and said overlapping skin to compress said resilient core of said second composite plate and thereafter, advancing said punch through said overlapping skin and said first skin of said second composite plate.

18. A method as defined in claim 17, wherein step (g) comprises withdrawing said punch from said overlapping skin and said first skin of said second composite plate and relieving the pressure from the overlapping skin and said first skin of said second composite plate and allowing the core of the second composite plate to expand.

19. A method as defined in claim 18, wherein steps (h) and (i) comprise applying pressure to said second skin of said second composite plate to compress said resilient core of said second composite plate and thereafter, advancing said punch through said second skin of said second composite plate, and thereafter, advancing said punch through said core of said second composite plate, said first skin of said second composite plate and said overlapping skin, thereby advancing said punch entirely through said second composite plate and said overlapping skin.

20. A method as defined in claim 19, wherein step (j) comprises withdrawing said punch from said overlapping skin and said second composite plate and relieving the pressure from the overlapping skin and said second composite plate and allowing the core of said second composite plate to expand into said hole.

21. A method as defined in claim 20, wherein step (k) comprises providing a rivet comprising a shank having first and second ends, and a head at said first end of said shank; passing said shank of said rivet through said hole; and securing said rivet to said second composite plate and said overlapping skin to prevent said rivet from disengaging from said hole.

22. The method as defined in claim 21, wherein said method is used to form a wall of a trailer.

23. A method as defined in claim 21, wherein said step (k) Comprises deforming said second end of said shank.

24. A method as defined in claim 21, further including the step of embossing said overlapping skin to deform an area of said overlapping skin around said hole in which the rivet head is accepted when said rivet is engaged through said hole.

25. A method as defined in claim 21, further including the step of embossing said second skin of said first composite plate to deform an area of said second skin of said second composite plate around said hole in which the rivet head is accepted when said rivet is engaged through said hole.

26. A method as defined in claim 16, wherein said punch has a shaped tip, and wherein said first skin-overlapping slug formed in step (f) has a reduced diameter relative to said hole, and wherein said second skin slug formed in step (h) has a reduced diameter relative to said hole.

27. A method as defined in claim 16, wherein said punch provided in step (e) comprises a shaft of predetermined diameter having a shoulder of a diameter larger than said predetermined diameter of said shaft, said hole formed in step (i) having a diameter approximately equivalent to said diameter of said shoulder.

28. A method as defined in claim 27, further including the step of:

(i1) allowing said core material to expand into said hole after forming said hole in step (i).

29. A method as defined in claim 28, wherein said core material expands behind said shoulder into an area of said hole not occupied by said shaft prior to said punch being withdrawn from said composite plate in step (j).

30. A method as defined in claim 27, wherein said punch has a shaped tip, and wherein said first skin-overlapping slug formed in step (f) has a reduced diameter relative to said hole, and wherein said second skin slug formed in step (h) has a reduced diameter relative to said hole.

31. A method as defined in claim 16, wherein said punch is advanced in steps (h) and (i) in alignment with said first skin-overlapping slug formed in step (f).

32. A method as defined in claim 16, wherein said first skin-overlapping slug formed in step (f) is slightly depressed into said core.

33. A method as defined in claim 16, further including the steps of:

(g1) flipping over said first and second composite plates; and (g2) positioning said flipped composite plates, whereby said punch is in direct alignment with said first skin slug.

34. A method as defined in claim 16, further including, prior to step (k), the steps of:

(j1) repunching said hole by advancing said punch through said hole to remove any excess core material which expanded into said hole; and (j2) rewithdrawing said punch from said second composite plate for a second time.

35. A method as defined in claim 34, wherein step (j1) comprises reapplying pressure to said second composite plate to recompress said resilient core of said second composite plate and thereafter, readvancing said punch through said hole in said overlapping skin and said second composite plate to shear any interfering core material out of said hole.

36. A method as defined in claim 35, wherein step (k) comprises providing a rivet comprising a shank having first and second ends, and a head at said first end of said shank; passing said shank of said rivet through said hole; and securing said rivet to said second composite plate to prevent said rivet from disengaging from said hole.

37. The method as defined in claim 35, wherein said method is used to form a wall of a trailer.

38. A method as defined in claim 36, further including the step of embossing said overlapping skin to deform an area of said overlapping skin around said hole in which the rivet head is accepted when said rivet is engaged through said hole.

39. A method as defined in claim 36, further including the step of embossing said second skin of said second composite plate to deform an area of said second skin of said second composite plate around said hole in which the rivet head is accepted when said rivet is engaged through said hole.

40. A method as defined in claim 34, wherein said punch has a shaped tip, and wherein said first skin-overlapping slug formed in step (f) has a reduced diameter relative to said hole, and wherein said second skin slug formed in step (h) has a reduced diameter relative to said hole.

41. A method as defined in claim 34, further including the steps of:

(g1) flipping over said first and second composite plates; and (g2) positioning said flipped composite plates, whereby said punch is in direct alignment with said first skin slug.

42. A method as defined in claim 33, wherein said step (k) comprises deforming said second end of said shank.

* * * * *

UNITED STATES PATENT AND TRADEMARK OFFICE

CERTIFICATE OF CORRECTION

PATENT NO. : 6,266,865 B1
DATED : July 31, 2001
INVENTOR(S) : Rodney P. Ehrlich

It is certified that error appears in the above-identified patent and that said Letters Patent is hereby corrected as shown below:

Column 15,
Line 2, "Comprises" should be -- comprises --
Line 9, "said first composite" should be -- said second composite --

Signed and Sealed this

Ninth Day of April, 2002

*Attest:*

*Attesting Officer*

JAMES E. ROGAN
*Director of the United States Patent and Trademark Office*